US012742600B2

(12) United States Patent
Chueh

(10) Patent No.: US 12,742,600 B2
(45) Date of Patent: Sep. 22, 2026

(54) FLEXIBLE HEAT DISSIPATION DEVICE

(71) Applicant: Wistron Corporation, New Taipei City (TW)

(72) Inventor: Yi-Hsuan Chueh, New Taipei City (TW)

(73) Assignee: WISTRON CORPORATION, New Taipei City (TW)

( * ) Notice: Subject to any disclaimer, the term of this patent is extended or adjusted under 35 U.S.C. 154(b) by 58 days.

(21) Appl. No.: 18/625,424

(22) Filed: Apr. 3, 2024

(65) Prior Publication Data

US 2025/0189242 A1 Jun. 12, 2025

(30) Foreign Application Priority Data

Dec. 8, 2023 (TW) ..... 112147994

(51) Int. Cl.
*F28F 3/02* (2006.01)

(52) U.S. Cl.
CPC ..... *F28F 3/027* (2013.01); *F28F 2255/02* (2013.01)

(58) Field of Classification Search
CPC ..... F28F 3/027; F28F 2255/02
USPC ..... 165/80.3, 185
See application file for complete search history.

(56) References Cited

U.S. PATENT DOCUMENTS 2,308,319 A * 1/1943 Stanton ..... F28F 1/36 165/184
2,829,511 A * 4/1958 Oesterle ..... C11C 5/006 431/291
3,582,045 A * 6/1971 Leybourne, III ... B01F 25/4314 138/42
3,589,687 A * 6/1971 Leybourne ..... B01J 19/30 422/310
4,056,143 A * 11/1977 Martin ..... F28F 1/22 165/125
5,031,694 A * 7/1991 Lloyd ..... F28F 1/12 165/184
5,184,675 A * 2/1993 Gardner ..... F28F 1/122 165/184

(Continued)

FOREIGN PATENT DOCUMENTS

CN 1118865 A 3/1996
JP 2021197295 A 12/2021

(Continued)

OTHER PUBLICATIONS

Examination report dated May 31, 2024, listed in related Taiwan patent application No. 112147994.

(Continued)

*Primary Examiner* — Claire E Rojohn, III
(74) *Attorney, Agent, or Firm* — McClure, Qualey & Rodack, LLP

(57) ABSTRACT

A flexible heat dissipation device includes a first flexible heat dissipation strip and a second flexible heat dissipation strip. The first flexible heat dissipation strip includes a first body portion and a first end portion, and the first end portion is connected to the first body portion. The second flexible heat dissipation strip includes a second body portion and a second end portion, and the second end portion is connected to the second body portion. The first body portion and the second body portion form a winding portion, and the first end portion is connected to the second end portion to form a fitting portion.

12 Claims, 14 Drawing Sheets

(56) References Cited

U.S. PATENT DOCUMENTS 5,497,824 A * 3/1996 Rouf ..... F28F 13/12 165/184
5,632,962 A * 5/1997 Baker ..... B01D 3/32 366/337
5,769,157 A * 6/1998 Ikejima ..... B23K 1/0012 165/184
5,785,088 A * 7/1998 Pai ..... F28D 15/046 165/184
6,399,031 B1 * 6/2002 Herrmann ..... F28D 7/08 165/184
6,418,020 B1 * 7/2002 Lin ..... H10W 40/22 174/16.3
6,427,765 B1 * 8/2002 Han ..... F28D 15/046 29/890.032
6,619,384 B2 * 9/2003 Moon ..... F28D 15/046 165/104.33
6,745,825 B1 * 6/2004 Nakamura ..... F28D 15/0233 165/104.33
7,140,421 B2 * 11/2006 Hsu ..... F28D 15/0233 29/890.032
7,159,647 B2 * 1/2007 Hsu ..... F28D 15/0233 165/104.21
8,393,079 B2 * 3/2013 Parmer ..... F28F 1/36 165/184
12,013,191 B2 * 6/2024 Smith ..... F28F 13/12
2002/0096314 A1 * 7/2002 Liu ..... B21C 37/20 165/184
2007/0131386 A1 * 6/2007 Tsai ..... G06F 1/20 257/722
2009/0032224 A1 * 2/2009 Numata ..... F28D 7/024 165/184
2009/0195990 A1 * 8/2009 Honma ..... F28F 3/022 361/710
2010/0276121 A1 * 11/2010 Sagie ..... F28D 20/02 165/110
2012/0312514 A1 * 12/2012 Erickson ..... F28D 7/16 165/184
2014/0127091 A1 * 5/2014 Wang ..... F15D 1/06 165/184
2014/0262190 A1 * 9/2014 Parmer ..... F28F 1/36 165/184
2014/0311709 A1 * 10/2014 Chan ..... F28D 7/12 165/104.11
2015/0292814 A1 * 10/2015 Kempiak ..... F28F 1/36 165/184
2015/0300745 A1 * 10/2015 Kolb ..... F28D 7/022 165/184
2015/0323260 A1 * 11/2015 Greber ..... F28D 9/0068 29/890.03
2018/0283797 A1 * 10/2018 Tochigi ..... F28D 15/0233
2020/0141661 A1 * 5/2020 Pitzak ..... B23K 15/0006
2025/0189242 A1 * 6/2025 Chueh ..... F28F 3/027

FOREIGN PATENT DOCUMENTS

WO 2005067036 A1 7/2005
WO 2019163313 A1 8/2019

OTHER PUBLICATIONS

Examination report dated Jul. 15, 2025, listed in correspondent Japan patent application No. 2024-079969.
Examination report dated Apr. 1, 2025, listed in related Japan patent application No. 2024-079969.

* cited by examiner

FLEXIBLE HEAT DISSIPATION DEVICE

CROSS-REFERENCE TO RELATED APPLICATION

This non-provisional application claims priority under 35 U.S.C. § 119(a) to Patent Application No. 112147994 filed in Taiwan, R.O.C. on Dec. 8, 2023, the entire contents of which are hereby incorporated by reference.

BACKGROUND

Technical Field

Provided is a heat dissipation device, and in particular, is a flexible heat dissipation device.

Related Art

With technological innovation and changes in business models, requirements for performance and stability of electronic products have increased significantly. To improve the performance and stability, a conventional heat dissipation method is to use a fin-type rigid body heat dissipation device to increase a heat dissipation area. However, a size of the rigid body heat dissipation device is often limited by an internal space of a system. In addition, a structure of the rigid body heat dissipation device is easily limited by a mold release direction of a mold and cannot be extended arbitrarily, and a large-size heat dissipation device may even be overweight.

SUMMARY

In view of the foregoing problems, an embodiment of the present disclosure provides a flexible heat dissipation device, including a first flexible heat dissipation strip and a second flexible heat dissipation strip. The first flexible heat dissipation strip includes a first body portion and a first end portion, and the first end portion is connected to the first body portion. The second flexible heat dissipation strip includes a second body portion and a second end portion, and the second end portion is connected to the second body portion. The first body portion and the second body portion form a strip winding portion, and the first end portion is connected to the second end portion to form a fitting portion.

In some embodiments, the first end portion overlaps the second end portion to form the fitting portion.

In some embodiments, the first flexible heat dissipation strip further includes a first tail end portion, the first tail end portion is connected to an other end of the first body portion, the second flexible heat dissipation strip further includes a second tail end portion, and the second tail end portion is connected to an other end of the second body portion.

In some embodiments, the first tail end portion is connected to the second tail end portion.

In some embodiments, the first flexible heat dissipation strip and the second flexible heat dissipation strip are integrally formed.

In some embodiments, the first tail end portion and the second tail end portion form a folded portion, the folded portion is triangular.

In some embodiments, the first body portion further comprising a plurality of first opening portions, each of the plurality of first opening portions is equidistantly arranged, the second body portion further comprising a plurality of second holes, and each of the plurality of second opening portions is equidistantly arranged.

In some embodiments, the third flexible heat dissipation strip and the fourth flexible heat dissipation strip are further included. The third flexible heat dissipation strip includes a third body portion and a third end portion, and the third end portion is connected to the third body portion. The fourth flexible heat dissipation strip includes a fourth body portion and a fourth end portion, and the fourth end portion is connected to the fourth body portion. The third body portion and the fourth body portion form an other strip winding portion, and the third end portion is connected to the fourth end portion to form an other fitting portion. A first extending portion extends from one of the first end portion or the second end portion, a second extending portion extends from the third end portion or the fourth end portion, and the first extending portion is connected to the second extending portion.

In some embodiments, the first flexible heat dissipation strip, the second flexible heat dissipation strip, the third flexible heat dissipation strip, and the fourth flexible heat dissipation strip are integrally formed.

In some embodiments, the fitting portion and the other fitting portion are located on a same plane.

In some embodiments, further comprising a bending portion, the bending portion is connected between one of the first flexible heat dissipation strip and the second flexible heat dissipation strip and one of the third flexible heat dissipation strip and the fourth flexible heat dissipation strip.

In some embodiments, at least part of the first flexible heat dissipation strip and the second flexible heat dissipation strip overlap each other.

In addition, a flexible heat dissipation device is provided in an embodiment, including a base and a plurality of heat dissipation elements. Each of the plurality of heat dissipation elements includes a first strip portion, a first end portion, a second strip portion, and a second end portion, the first end portion is connected to the first strip portion, the second end portion is connected to the second strip portion, the first strip portion and the second strip portion form a strip winding portion, the first end portion is connected to the second end portion to form a fitting portion, and the fitting portion is fitted on the base.

In some embodiments, the first strip portion further includes a first tail end portion, the first tail end portion is connected to an other end of the first strip portion, the second strip portion further includes a second tail end portion, and the second tail end portion is connected to an other end of the second strip portion.

In some embodiments, the first tail end portion is connected to the second tail end portion.

In some embodiments, the first tail end portion and the second tail end portion form a folded portion, the folded portion is triangular.

In some embodiments, the base includes a first body and a second body on opposite sides, one of the fitting portions is fitted to the first body of the base, and the other of the fitting portions is fitted to the second body of the base.

In some embodiments, the first strip portion further comprising a plurality of first openings, each of the plurality of first openings is equidistantly arranged, the second strip portion further comprising a plurality of second openings, and each of the plurality of second openings is equidistantly arranged.

In some embodiments, the plurality of heat dissipation elements and the base are integrally formed.

In conclusion, a flexible heat dissipation device is provided in an embodiment. The first flexible heat dissipation strip and the second flexible heat dissipation strip form a strip winding portion, and may be fitted on an apparatus through the fitting portion. Based on the flexibility of the flexible heat dissipation device, the flexible heat dissipation device can be applied to various apparatuses. According to a shape, a structure, and the like of an internal space of the apparatus, the flexible heat dissipation device can also be bent into a shape suitable for arrangement.

DETAILED DESCRIPTION

Figure 1:
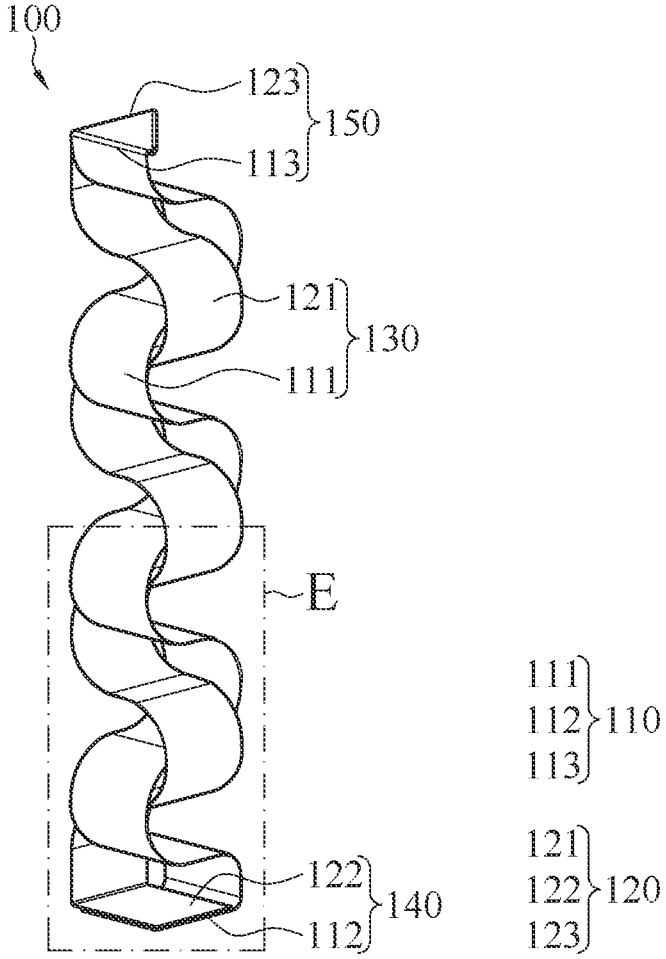
FIG. 1 is a three-dimensional diagram of a flexible heat dissipation device according to some embodiments.

Refer to FIG. 1. FIG. 1 is a three-dimensional diagram of a flexible heat dissipation device according to some embodiments. A flexible heat dissipation device 100 includes a first flexible heat dissipation strip 110 and a second flexible heat dissipation strip 120. The first flexible heat dissipation strip 110 includes a first body portion 111 and a first end portion 112, and the first end portion 112 is connected to the first body portion 111. The second flexible heat dissipation strip 120 includes a second body portion 121 and a second end portion 122, and the second end portion 122 is connected to the second body portion 121. The first body portion 111 and the second body portion 121 form a strip winding portion 130, the first end portion 112 and the second end portion 122 are planes, and the first end portion 112 overlaps and is connected to the second end portion 122 to form a planar fitting portion 140.

During use, the fitting portion 140 of the flexible heat dissipation device 100 is configured to be in contact with a component to be dissipated (such as a heat source) for heat exchange. Then the fitting portion 140 conducts heat to the strip winding portion 130. Since the strip winding portion 130 has a large heat dissipation area and a gap allows airflows to pass through, the strip winding portion 130 may achieve a better heat dissipation effect.

Second, the first flexible heat dissipation strip 110 and the second flexible heat dissipation strip 120 may be made of a flexible material, and may be bent according to requirements to form the strip winding portion 130. For example, the flexible heat dissipation device 100 is manufactured by winding the first flexible heat dissipation strip 110 and the second flexible heat dissipation strip 120 to form the strip winding portion 130. In some embodiments, to wind the first flexible heat dissipation strip 110 and the second flexible heat dissipation strip 120 means to arrange in at least an overlapping position of the first flexible heat dissipation strip 110 and the second flexible heat dissipation strip 120. When the flexible heat dissipation device is applied to, for example, a drone, a mixed reality helmet, or another apparatus with a narrow internal space, a user may apply a force to elongate or compress the strip winding portion 130 (that is a distance in a vertical direction from the perspective of FIG. 1) according to a space of a heat dissipation device in the apparatus, to adjust a size of the flexible heat dissipation device 100 to be adapted to the internal space of the apparatus. In addition, the user can also bend the strip winding portion 130 according to a shape of the space of the heat dissipation device for accommodation, and make corresponding adaptation, for example, make the strip winding portion 130 in an S-shape, an L-shape, or other shapes. Therefore, the user can fit the fitting portion 140 to a surface of a heat source in the apparatus to conduct heat to the strip winding portion 130. Since the airflow can pass through a gap generated after the first flexible heat dissipation strip 110 and the second flexible heat dissipation strip 120 are wound, heat generated by the heat source can be dissipated in the strip winding portion 130. Therefore, the flexible heat dissipation device 100 can not only change the size through the strip winding portion 130, but also maintain the heat dissipation effect.

Figure 2:
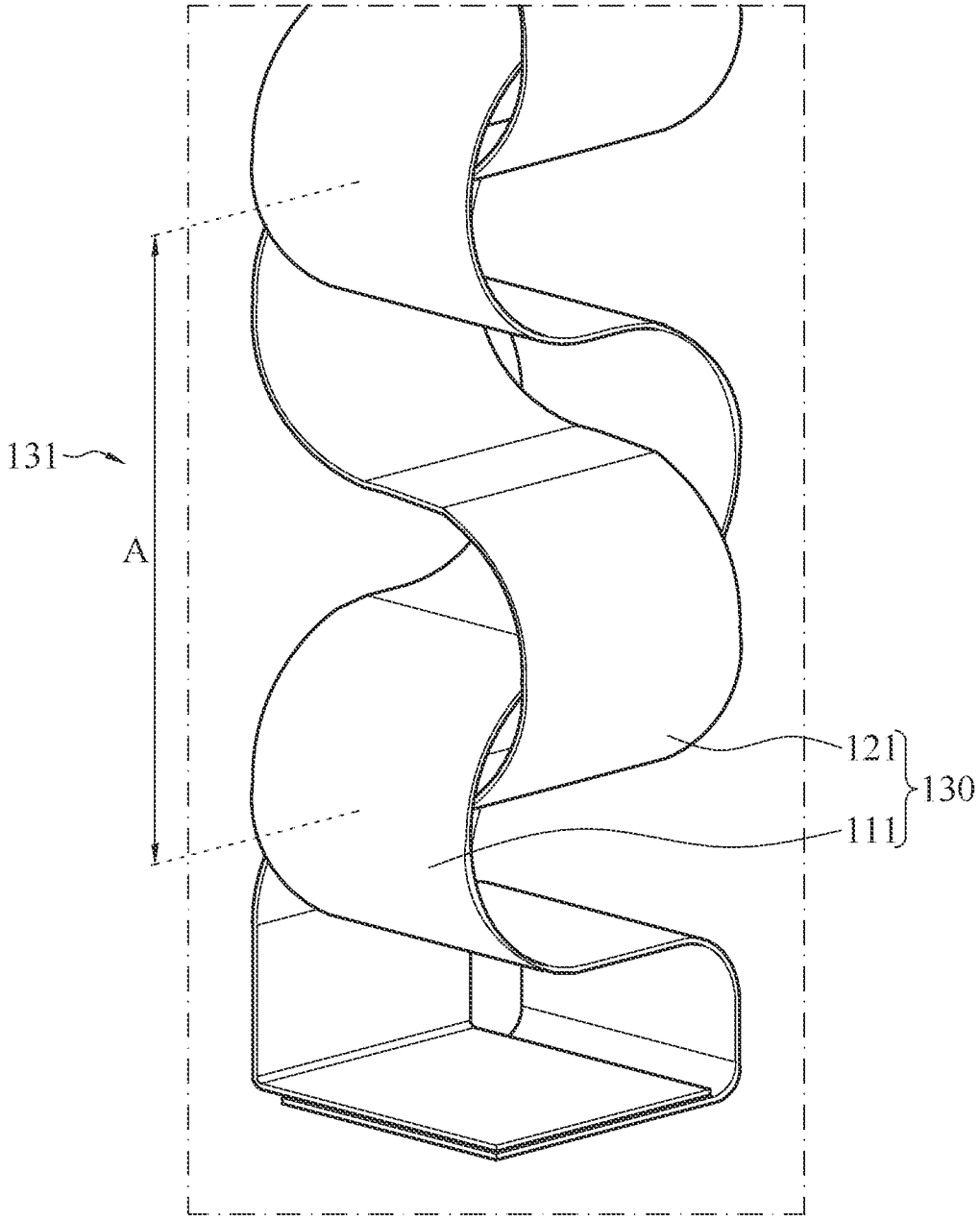
FIG. 2 is a partial enlarged view of a position marked by E in FIG. 1.

Refer to FIG. 2. FIG. 2 is a partial enlarged view of a position marked by E in FIG. 1. The strip winding portion 130 includes a reduplicating section 131 (a section marked by A in FIG. 2). The reduplicating section 131 refers to a section from a peak of a bend to a peak of a next bend. A length of the reduplicating section 131 in a vertical direction in FIG. 2 is referred to as a section distance A. When the strip winding portion 130 is over-compressed, the first body portion 111 and the second body portion 121 are relatively close to each other. In this way, the section distance A becomes shorter, which reduces the gap for the airflow to pass through the strip winding portion 130. Conversely, the strip winding portion 130 is stretched to lengthen the section distance A, which can increase the gap between the strip winding portions 130 and improve the heat dissipation effect. In this way, the strip winding portion 130 has a sufficient gap for the airflow to pass through to maintain the heat dissipation effect. In some embodiments, a quantity of reduplicating sections 131 of the strip winding portion 130 may also be increased or reduced according to use requirements. For example, the quantity may be reduced to only 0.5 reduplicating sections 131 in one strip winding portion 130.

Still refer to FIG. 1. In some embodiments, the first flexible heat dissipation strip 110 further includes a first tail end portion 113, and the first tail end portion 113 is connected to an other end of the first body portion 111 that is relative to the first end portion 112, the second flexible heat dissipation strip 120 further includes a second tail end portion 123, and the second tail end portion 123 is connected to an other end of the second body portion 121 that is relative to the second end portion 122. In some embodiments, the first tail end portion 113 is connected to the second tail end portion 123, so that the first flexible heat dissipation strip 110 and the second flexible heat dissipation strip 120 are connected to each other. In some embodiments, the first flexible heat dissipation strip 110 and the second flexible heat dissipation strip 120 are not limited to connecting the first tail end portion 113 to the second tail end portion 123, and the first flexible heat dissipation strip 110 and the second flexible heat dissipation strip 120 may be connected to each other through winding of the first body portion 111 and the second body portion 121 and fitting of the first end portion 112 and the second end portion 122. Further, as shown in FIG. 1, a folded portion 150 is formed between the first tail end portion 113 and the second tail end portion 123. In some embodiments, the folded portion 150 is triangular and the fitting portion 140 is rectangular, but the present disclosure is not limited thereto. In the following manufacturing method, according to different included angles between the first tail end portion 113 and the second tail end portion 123, the folded portion 150 may also have different shapes. According to different shapes of the first end portion 112 and the second end portion 122, the fitting portion 140 may also have different shapes.

Figure 3:
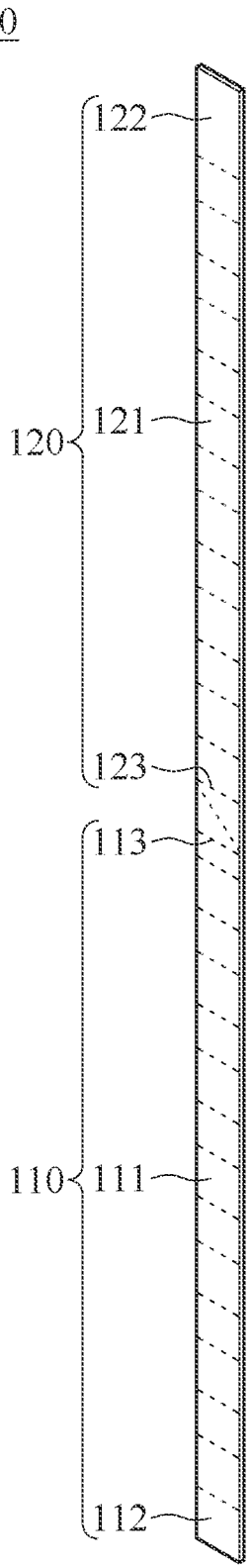
FIG. 3 is a schematic three-schematic diagram of an expanded view of the flexible heat dissipation device according to the embodiment of FIG. 1.

In the foregoing embodiments, the first flexible heat dissipation strip 110 and the second flexible heat dissipation strip 120 may each be an independent element, and may be connected to each other at the first tail end portion 113 and the second tail end portion 123 or may be connected to each other at the first end portion 112 and the second end portion 122. However, the present disclosure is not limited thereto. In some embodiments, the first flexible heat dissipation strip 110 and the second flexible heat dissipation strip 120 are two sections of a single strip-shaped element (briefly referred to as a single element) that is integrally formed (as shown in FIG. 3). The method of manufacturing the flexible heat dissipation device 100 from this single strip-shaped element can be seen in FIG. 3 to FIG. 6.

Figure 4:
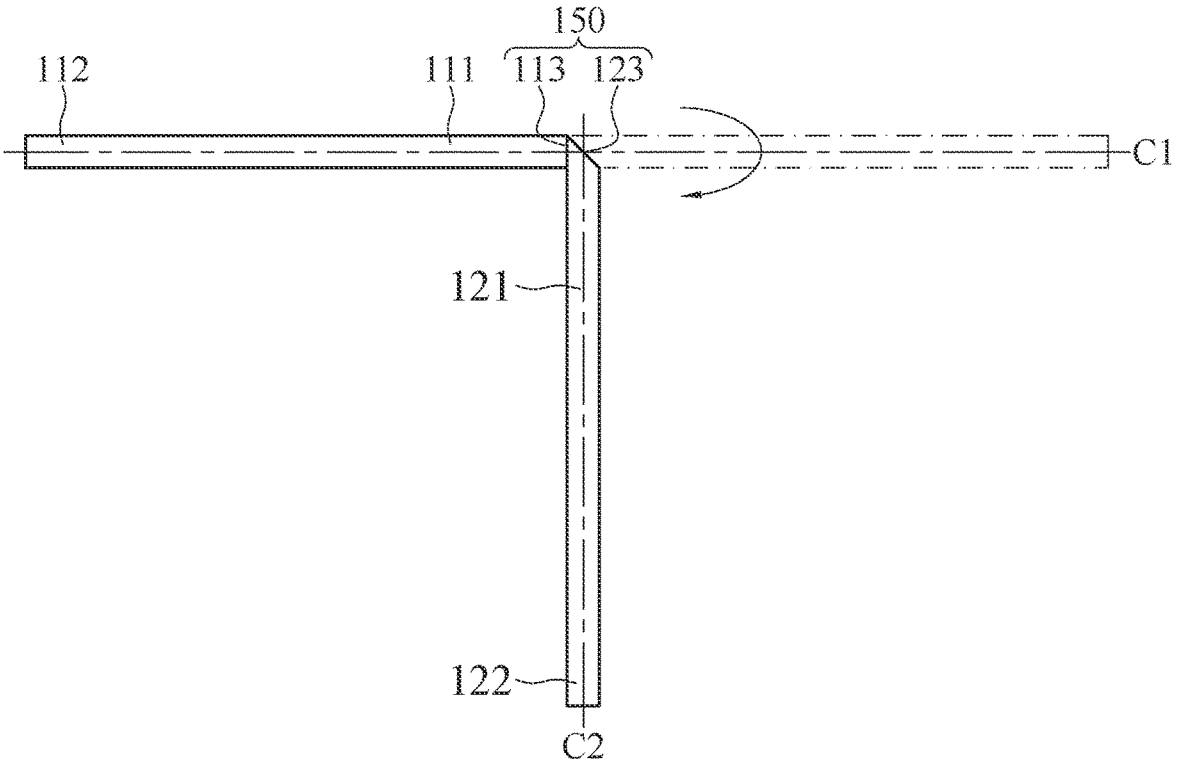
FIG. 4 is a schematic diagram (1) of a manufacturing process of the flexible heat dissipation device according to the embodiment of FIG. 1.
Figure 5:
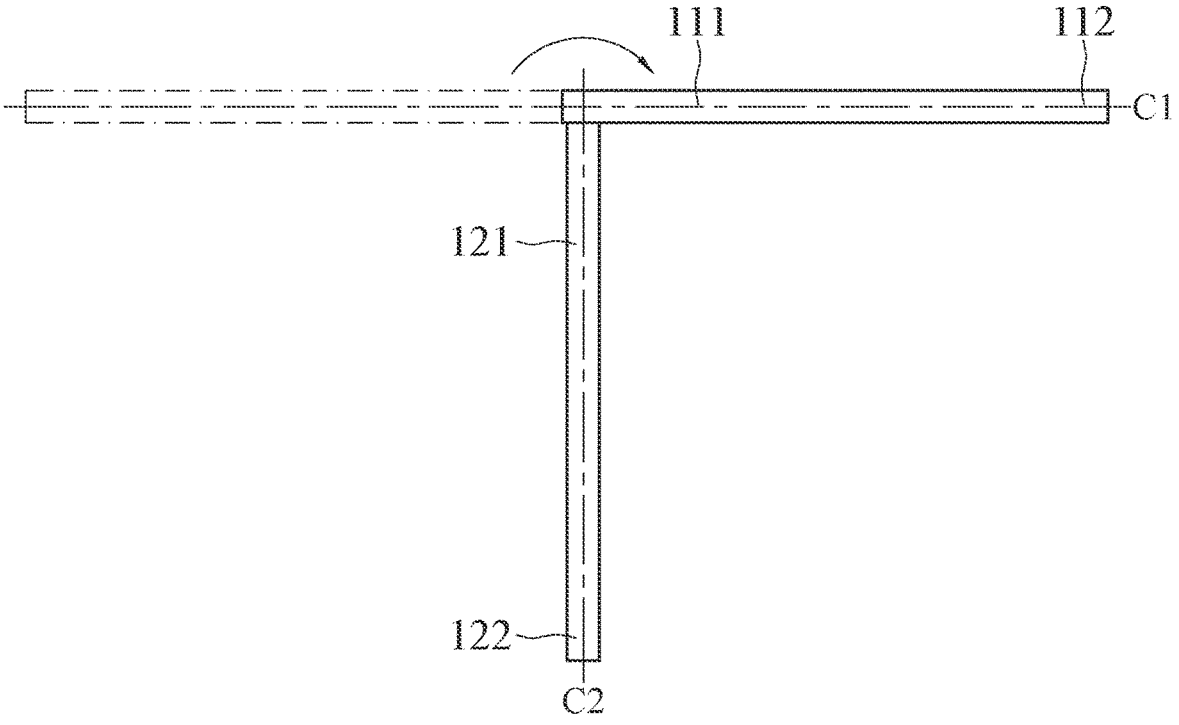
FIG. 5 is a schematic diagram (2) of a manufacturing process of the flexible heat dissipation device according to the embodiment of FIG. 1.
Figure 6:
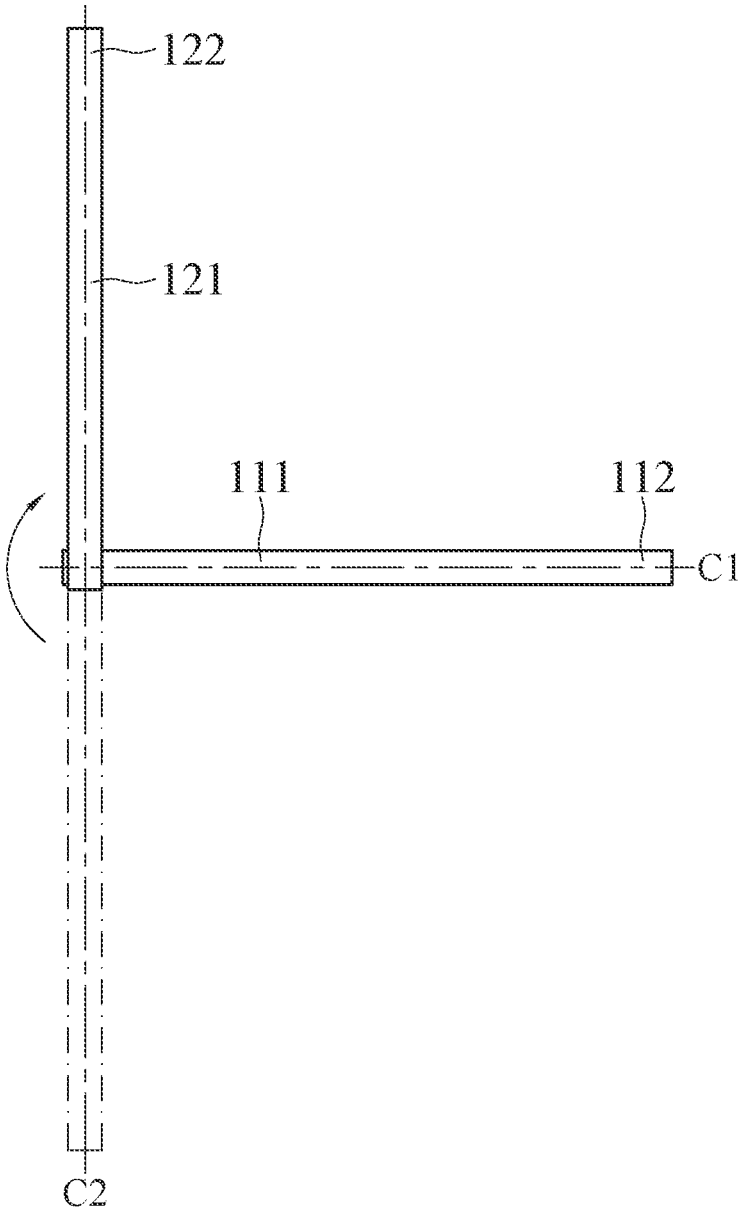
FIG. 6 is a schematic diagram (3) of a manufacturing process of the flexible heat dissipation device according to the embodiment of FIG. 1.

Refer to FIG. 3 to FIG. 6. FIG. 3 is a schematic three-schematic diagram of an expanded view of the flexible heat dissipation device according to the embodiment of FIG. 1. FIG. 4 is a schematic diagram (1) of a manufacturing process of the flexible heat dissipation device according to the embodiment of FIG. 1. FIG. 5 is a schematic diagram (2) of a manufacturing process of the flexible heat dissipation device according to the embodiment of FIG. 1. FIG. 6 is a schematic diagram (3) of a manufacturing process of the flexible heat dissipation device according to the embodiment of FIG. 1. The flexible heat dissipation device 100 shown in FIG. 3 is in an unfolded state before being wound. First, as shown in FIG. 4, the second body portion 121 is bent, so that a long axis C2 of the second body portion 121 is substantially perpendicular to a long axis C1 of the first body portion 111, and a folded edge of an overlapping portion where the second body portion 121 and the first body portion 111 bend forms an angle of approximately 45 degrees with the long axis C1 of the first body portion 111 (that is, the long axis C1 of the first body portion 111 and the long axis C2 of the second body portion 121 form an angle of 90 degrees). Next, as shown in FIG. 5, the first body portion 111 is bent toward an opposite side (at which the second body portion 121 is originally located in FIG. 3). Next, as shown in FIG. 6, the second body portion 121 is bent toward an opposite side. Further, the process of FIG. 5 and FIG. 6 is repeated. The first body portion 111 and the second body portion 121 are repeatedly overlapped until, as shown in FIG. 1, the first body portion 111 and the second body portion 121 form a strip winding portion 130. The first end portion 112 and the second end portion 122 are connected to form the planar fitting portion 140. Still refer to FIG. 4. In this embodiment, it is shown that the folded edge of the overlapping portion where the second body portion 121 and the first body portion 111 bend forms an angle of approximately 45 degrees with the long axis C1 of the first body portion 111. However, the present disclosure is not limited thereto. In some embodiments, the folded edge of the overlapping portion where the second body portion 121 and the first body portion 111 bend may also form an included angle of approximately 25 to 65 degrees with the long axis C1 of the first body portion 111 (that is, the long axis C1 of the first body portion 111 and the long axis C2 of the second body portion 121 form an angle of 45 to 135 degrees). In some embodiments, the first body portion 111 and the second body portion 121 is prevent from being repeatedly overlapped and overly compressed, and affecting the heat dissipation effect.

Still refer to FIG. 1. In this embodiment, the first end portion 112 overlaps the second end portion 122 to form the fitting portion 140. The first end portion 112 in this embodiment is a square plane, and the second end portion 122 is also a square plane. The two planes are overlapped and connected to form the fitting portion 140 with an overlapping plane. However, the present disclosure is not limited thereto. The first end portion 112 and the second end portion 122 each may also be a right-angled triangular plane, and the fitting portion 140 with a complete square plane is formed by splicing two right-angled triangular planes. In some embodiments, the first end portion 112 and the second end portion 122 are not in contact with each other, that is, both are respectively fitted to the element to be dissipated but end edges of both are separated by a distance.

Figure 7:
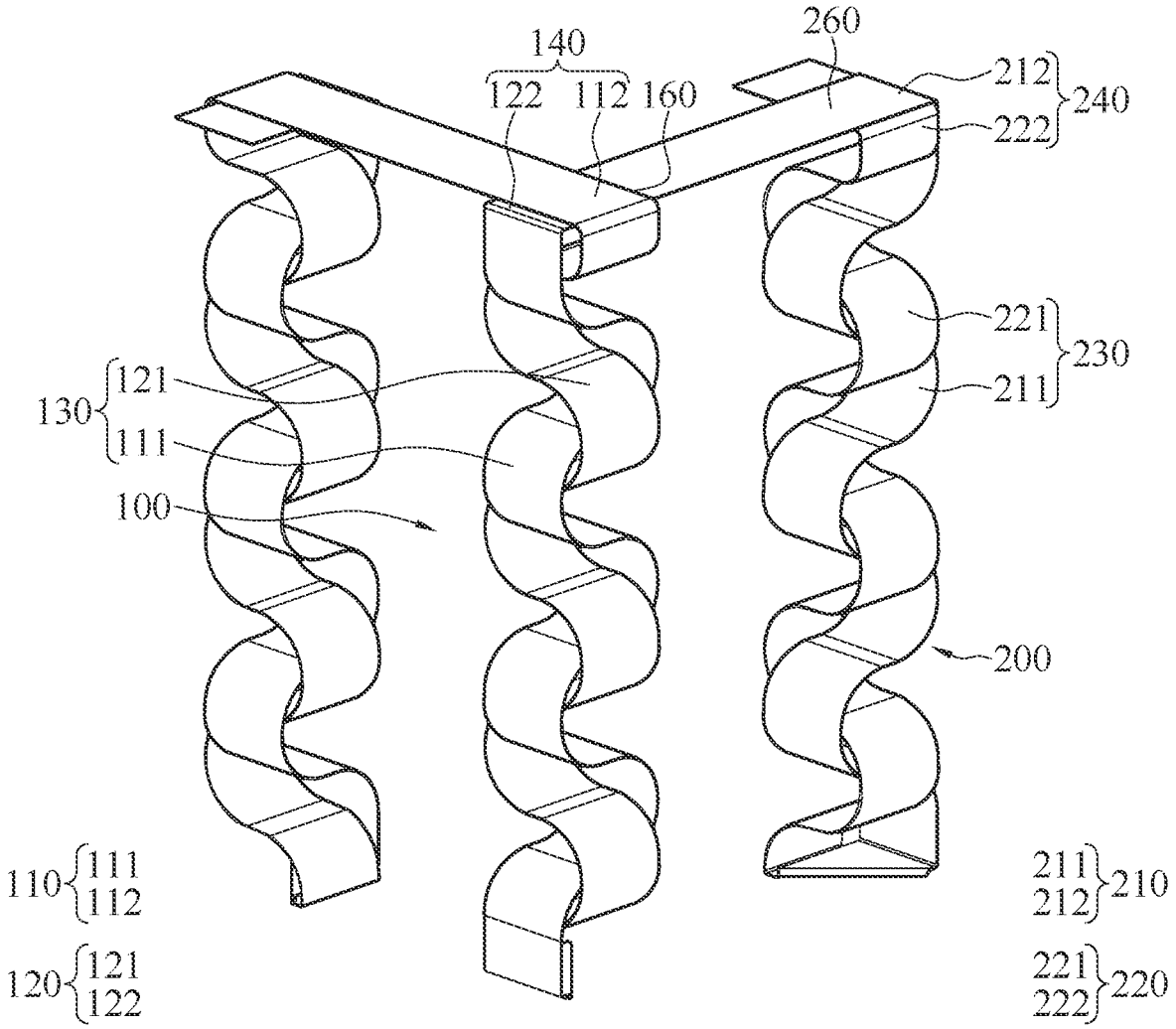
FIG. 7 is a schematic three-dimensional diagram of a flexible heat dissipation device according to some embodiments.
Figure 8:
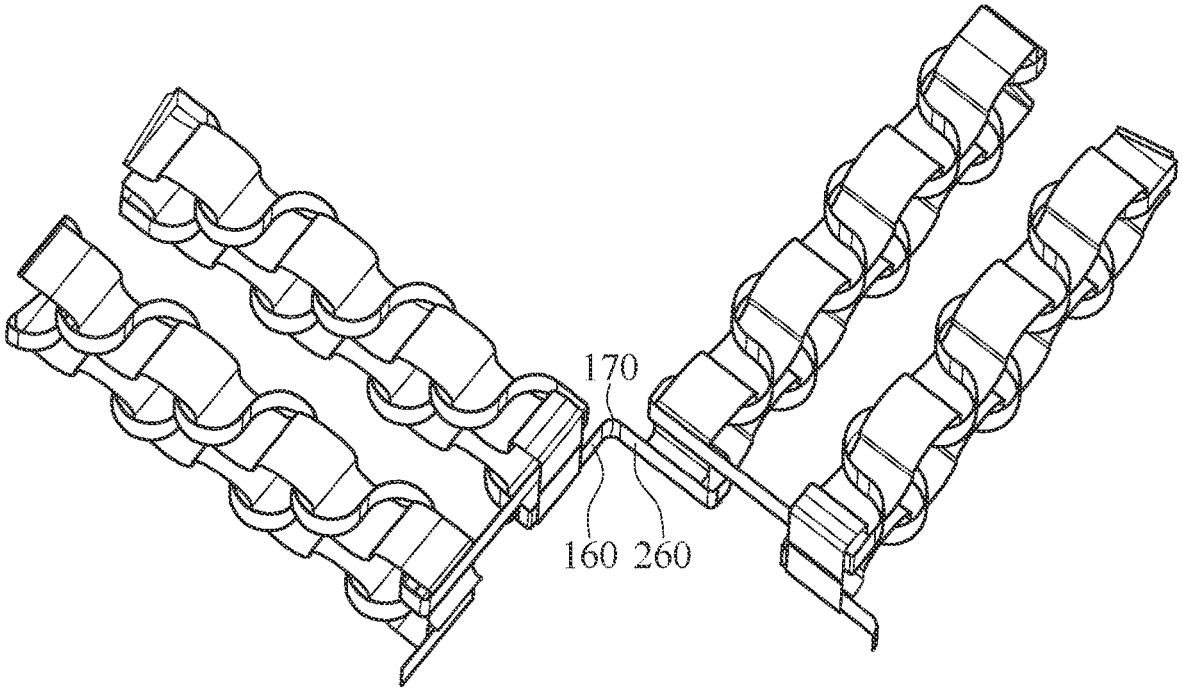
FIG. 8 is a schematic three-dimensional diagram of another application of the flexible heat dissipation device according to the embodiment of FIG. 7.

Refer to FIG. 7 and FIG. 8. FIG. 7 is a schematic three-dimensional diagram of a flexible heat dissipation device according to some embodiments. FIG. 8 is a schematic three-dimensional diagram of another application of the flexible heat dissipation device according to the embodiment of FIG. 7. In this embodiment, the flexible heat dissipation device 100 is connected to another flexible heat dissipation device 200. The another flexible heat dissipation device 200 has a same structure as the flexible heat dissipation device 100, so the same parts are not repeated. The another flexible heat dissipation device 200 includes a third flexible heat dissipation strip 210 and a fourth flexible heat dissipation strip 220. The third flexible heat dissipation strip 210 is provided with a third body portion 211 and a third end portion 212. The third end portion 212 is connected to the third body portion 211. The fourth flexible heat dissipation strip 220 is provided with a fourth body portion 221 and a fourth end portion 222. The fourth end portion 222 is connected to the fourth body portion 221. The third body portion 211 and the fourth body portion 221 form an other strip winding portion 230, and the third end portion 212 is connected to the fourth end portion 222 to form an other fitting portion 240.

As shown in FIG. 7, in this embodiment, a first extending portion 160 extends from one of the first end portion 112 and the second end portion 122, a second extending portion 260 extends from one of the third end portion 212 and the fourth end portion 222, and the first extending portion 160 is connected to the second extending portion 260. In this way, a plurality of structures that form a flexible heat dissipation device may be connected according to requirements for heat dissipation, an apparatus structure, and the like. In this embodiment, only the third flexible heat dissipation strip 210 and the fourth flexible heat dissipation strip 220 as the another flexible heat dissipation device 200 are disclosed, but the present disclosure is not limited thereto. As shown in FIG. 7, there may also be a flexible heat dissipation device formed by a fifth flexible heat dissipation strip and a sixth flexible heat dissipation strip.

As shown in FIG. 7, in this embodiment, the fitting portion 140 and the other fitting portion 240 are located on a same plane, and can be fitted to an apparatus with a smooth surface, but the present disclosure is not limited thereto. As shown in FIG. 8, in some embodiments, when it is intended to be applied to an apparatus with a curved or bent surface, a bending portion 170 is arranged between the first extending portion 160 and the second extending portion 260. Through bending, the fitting portion 140 and the other fitting portion 240 are non-coplanar, for example, are respectively located on two different planes that are intersected. In this way, the fitting portion 140 and the other fitting portion 240 can be fitted to, for example, the apparatus with a curved or bent surface.

As shown in FIG. 7 and FIG. 8, in this embodiment, the flexible heat dissipation device 100 and the another flexible heat dissipation device 200 can each be an independent element and connected to each other through the extending portion to form a single element, but the present disclosure is not limited thereto. In some embodiments, the first flexible heat dissipation strip 110 and the second flexible heat dissipation strip 120 of the flexible heat dissipation device 100 and the third flexible heat dissipation strip 210 and the fourth flexible heat dissipation strip 220 of the another flexible heat dissipation device 200 are originally a single strip-shaped element, that is, a heat dissipation strip formed integrally.

Figure 9:
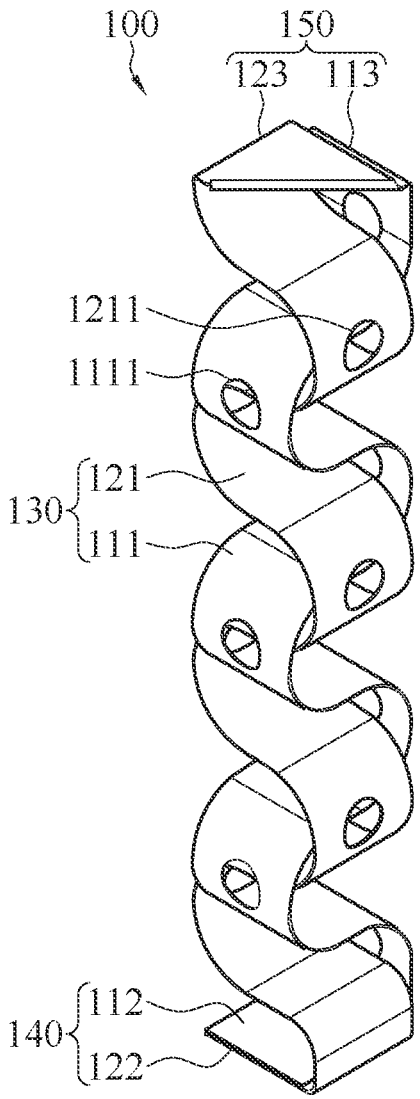
FIG. 9 is a three-dimensional diagram of a flexible heat dissipation device according to some embodiments.

Refer to FIG. 9. FIG. 9 is a three-dimensional diagram of a flexible heat dissipation device according to some embodiments. In this embodiment, the first body portion 111 further comprising a plurality of first opening portions 1111 arranged equidistantly, the second body portion 121 further comprising a plurality of second opening portions 1211 arranged equidistantly, and the plurality of first opening portions 1111 and the plurality of second opening portions 1211 are alternately arranged in the strip winding portion 130. As shown in FIG. 9, the plurality of first opening portions 1111 in the strip winding portion 130 are respectively located at peaks of bends of the first body portion 111, and the plurality of second opening portions 1211 are respectively located at peaks of bends of the second body portion 121. In this way, the first opening portions 1111 and the second opening portions 1211 that are alternately arranged are formed, to improve the heat dissipation effect of the flexible heat dissipation device 100 through the plurality of opening portions.

Figure 10:
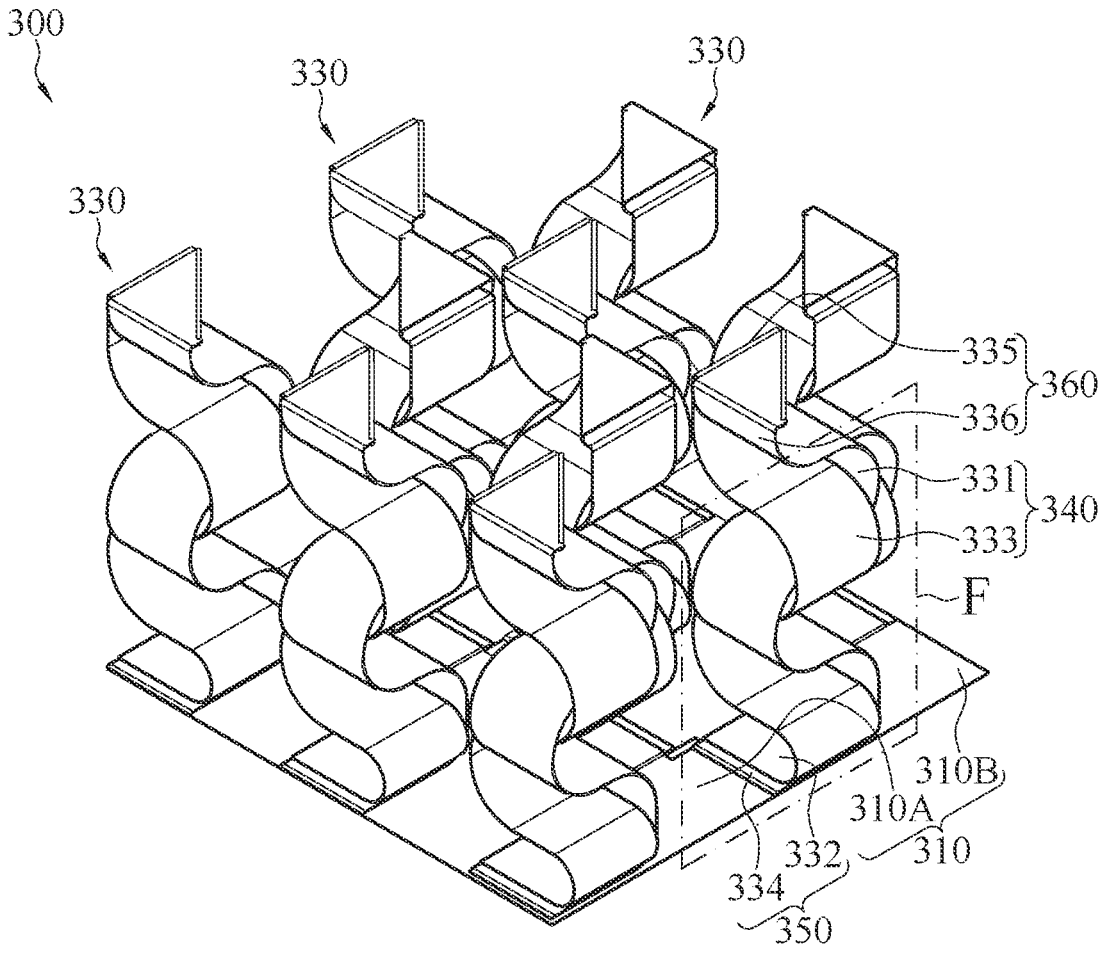
FIG. 10 is a three-dimensional diagram of a flexible heat dissipation device according to some embodiments.
Figure 11:
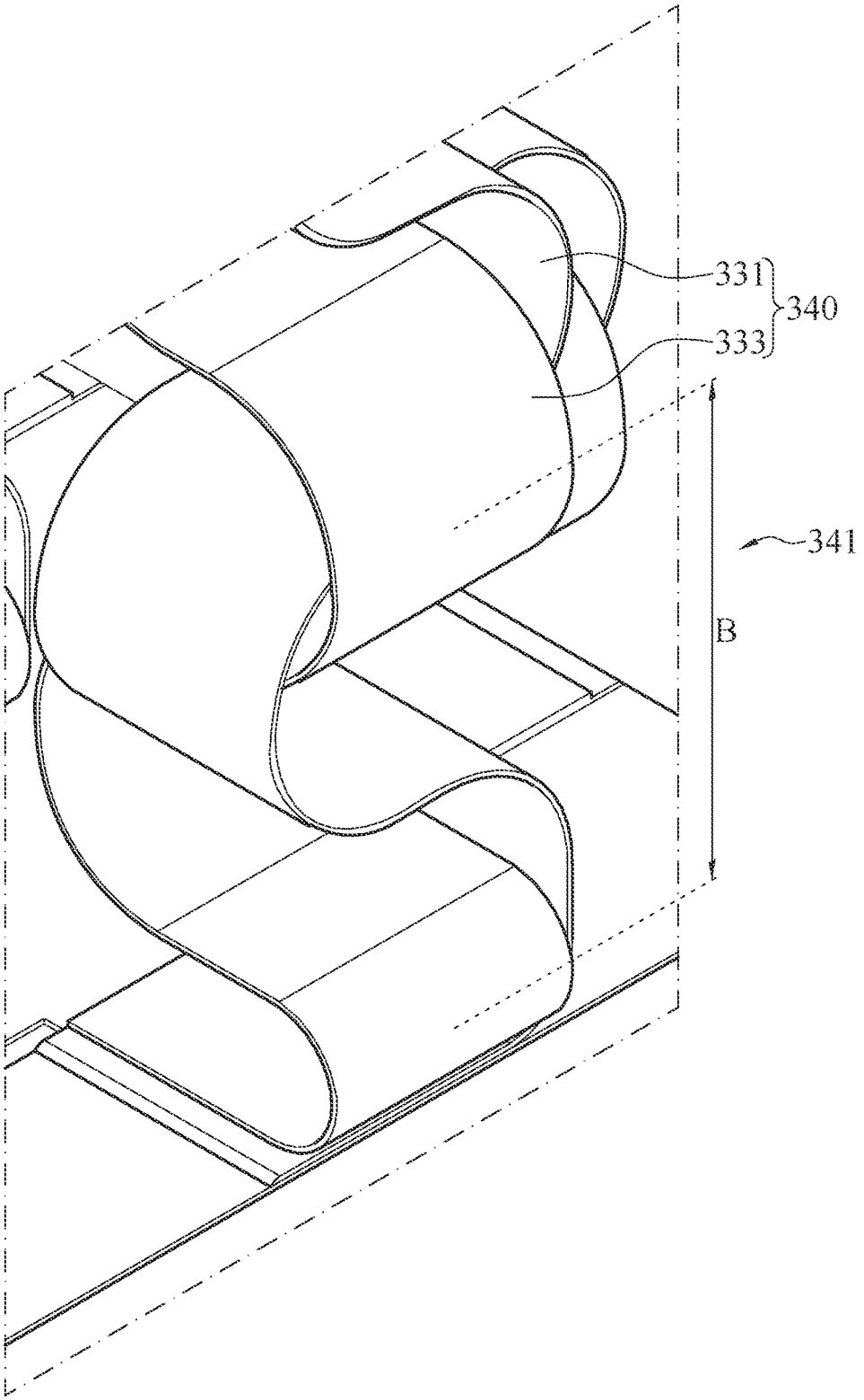
FIG. 11 is a partial enlarged view of a position marked by F in FIG. 10.

Refer to FIG. 10 and FIG. 11. FIG. 10 is a three-dimensional diagram of a flexible heat dissipation device according to some embodiments. FIG. 11 is a partial enlarged view of a position marked by F in FIG. 10. The foregoing embodiment shows that the flexible heat dissipation device 100 is connected to the another flexible heat dissipation device 200 through the extending portion, but the present disclosure is not limited thereto. In this embodiment, a flexible heat dissipation device 300 includes a base 310 and a plurality of heat dissipation elements 330. As shown in FIG. 10 and FIG. 11, each of the plurality of heat dissipation elements 330 of the flexible heat dissipation device 300 includes a first strip portion 331, a first end portion 332, a second strip portion 333, and a second end portion 334. The first end portion 332 is connected to the first strip portion 331, the second end portion 334 is connected to the second strip portion 333, the first strip portion 331 and the second strip portion 333 form a strip winding portion 340, the first end portion 332 is connected to the second end portion 334 to form a fitting portion 350, and the fitting portion 350 is fitted on the base 310. In this embodiment, the base 310 and the plurality of heat dissipation elements 330 are a single element integrally formed, but the present disclosure is not limited thereto. The base 310 and the plurality of heat dissipation elements 330 may also be independent elements. In this embodiment, the flexible heat dissipation device 300 is also made of a flexible material, and a part of the base 310 is bent to form the heat dissipation element 330. Then, the portion of the heat dissipation element 330 is wound to form the strip winding portion 340 to complete a structure similar to the flexible heat dissipation device 100, and the flexible heat dissipation device 300 is connected to the flexible heat dissipation device 100 and another flexible heat dissipation device 200 to be applied to the element to be dissipated.

As shown in FIG. 11, in this embodiment, the strip winding portion 340 includes a reduplicating section 341 (a section marked by B in FIG. 11). As shown in FIG. 14, the reduplicating section 341 refers to a section from the peak of the bend to the peak of the next bend, which prevents the strip winding portion 340 from being over-compressed, so that the first strip portion 331 and the second strip portion 333 are tightly connected to each other. As a result, it is difficult for the airflow to pass through the gap of the strip winding portion 340, and the heat dissipation effect is degraded. In some embodiments, a quantity of reduplicating sections 341 of the strip winding portion 340 can also be increased or reduced according to usage requirements. For example, it can be reduced to only 0.5 reduplicating sections 341 in one strip winding portion 340. The winding method of the flexible heat dissipation device 300 can be seen in FIG. 12 to FIG. 14.

Figure 12:
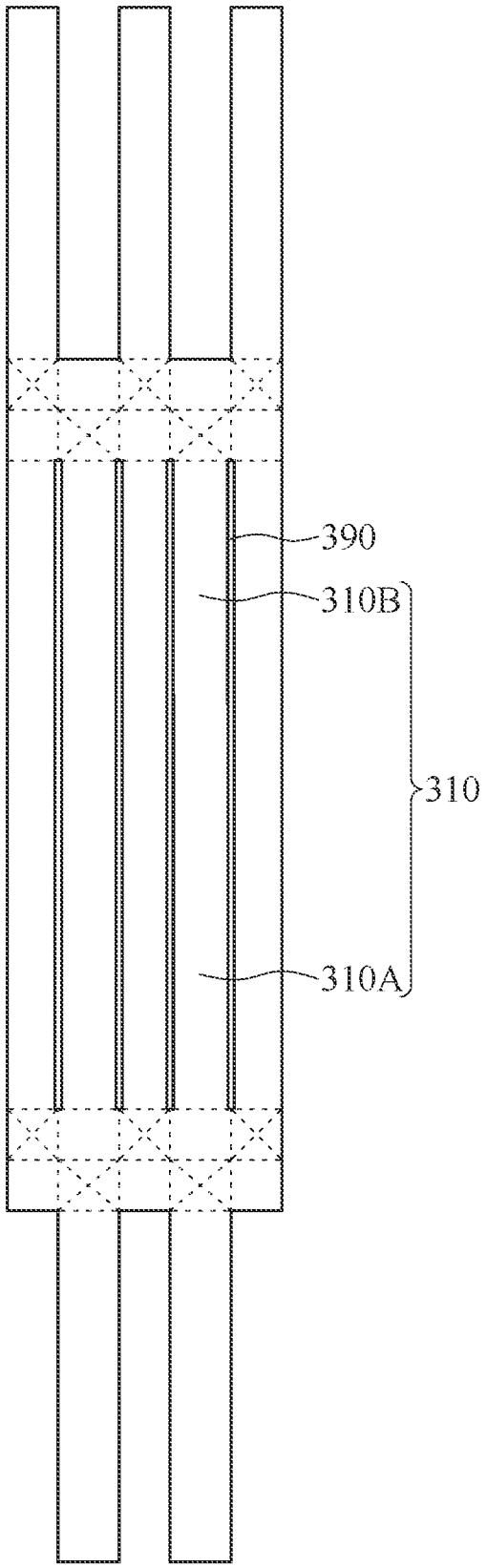
FIG. 12 is a schematic diagram (1) of a manufacturing process of the flexible heat dissipation device according to the embodiment of FIG. 10.
Figure 13:
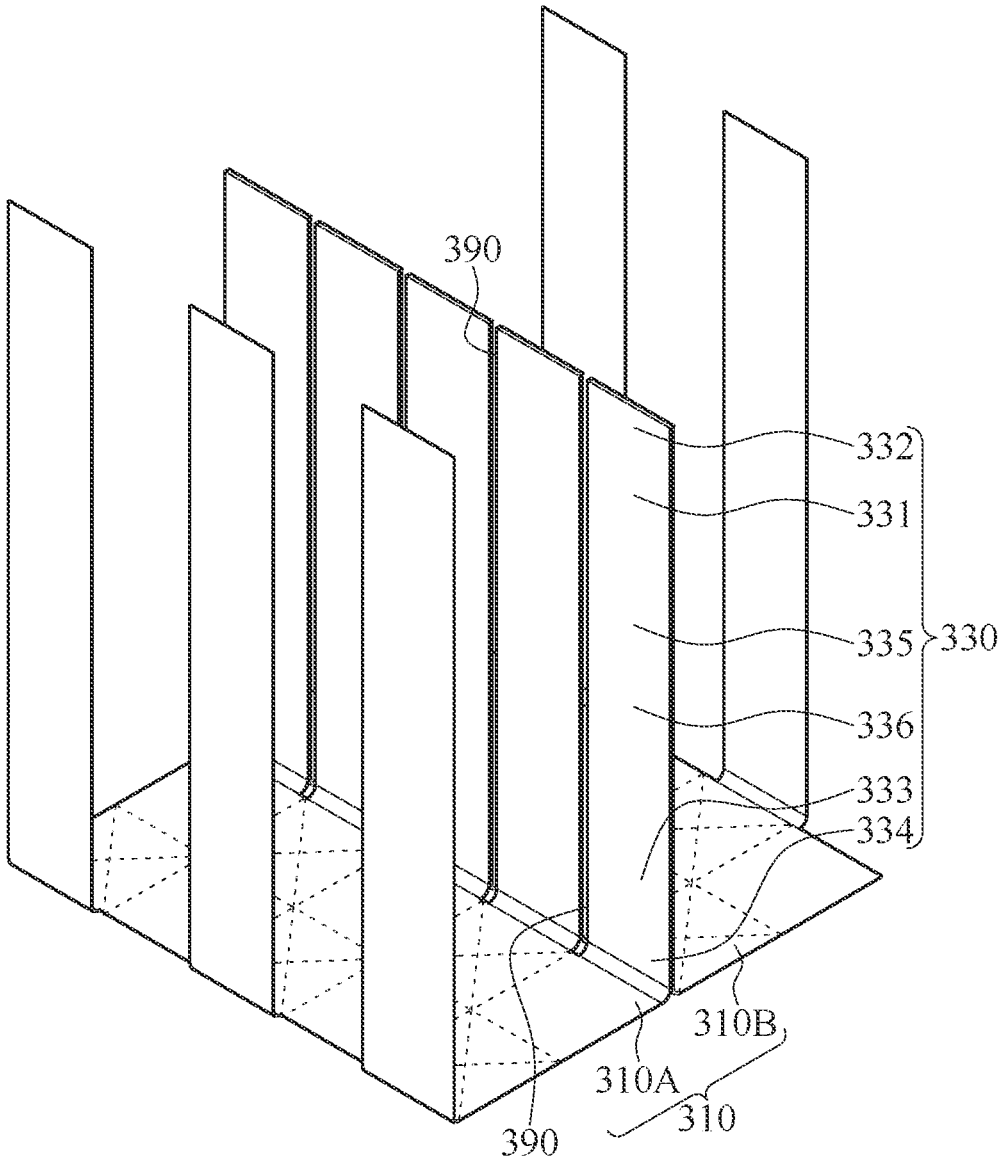
FIG. 13 is a schematic diagram (2) of a manufacturing process of the flexible heat dissipation device according to the embodiment of FIG. 10.
Figure 14:
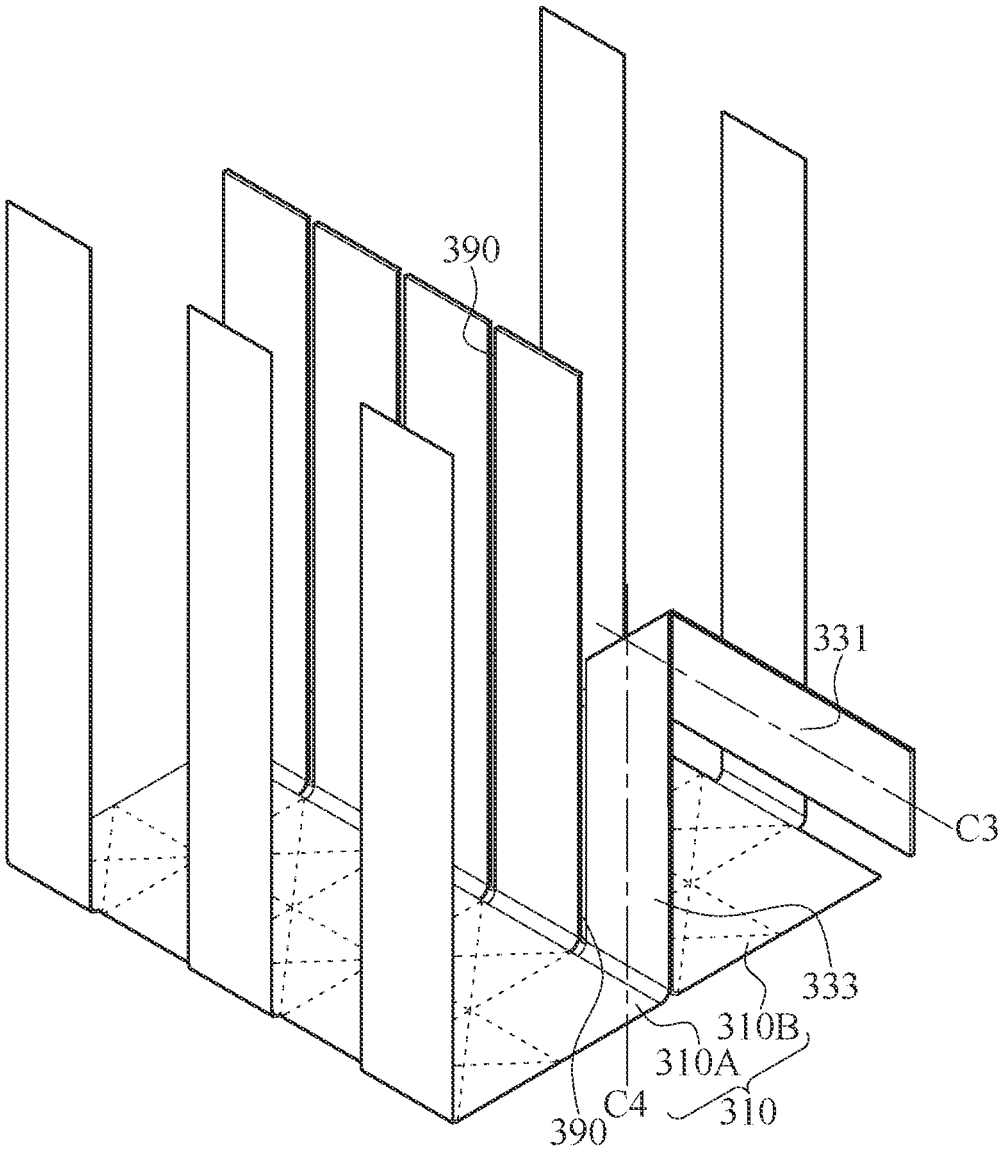
FIG. 14 is a schematic diagram (3) of a manufacturing process of the flexible heat dissipation device according to the embodiment of FIG. 10.

Refer to FIG. 12 to FIG. 14. FIG. 12 is a schematic diagram (1) of a manufacturing process of the heat dissipation device according to the embodiment of FIG. 10. FIG. 13 is a schematic diagram (2) of a manufacturing process of the heat dissipation device according to the embodiment of FIG. 10. FIG. 14 is a schematic diagram (3) of a manufacturing process of the heat dissipation device according to the embodiment of FIG. 10. FIG. 12 shows a state of the flexible heat dissipation device 300 before being wound. First, as shown in FIG. 13, the base 310 is partially folded and overlapped with each other, and a left side and a right side are bent together. Based on a plurality of slots 390 on the base 310, the overlapping part of the base 310 forms a plurality of heat dissipation elements 330, and the bent parts on the left side and the right side also form a plurality of heat dissipation elements 330. Next, as shown in FIG. 14, the first strip portion 331 is bent, so that a long axis C3 of the first strip portion 331 is substantially perpendicular to a long axis C4 of the second strip portion 333, and a folded edge of an overlapping portion of the first strip portion 331 and the second strip portion 333 forms an angle of approximately 45 degrees with the long axis C4 of the second strip portion 333 (that is, the long axis C3 of the first strip portion 331 and the long axis C4 of the second strip portion 333 form an angle of 90 degrees). Next, the overlapping portion where the first strip portion 331 and the second strip portion 333 bend is held and bent toward the second strip portion 333. Next, the first strip portion 331 is bent toward the opposite side. The actions of bending the overlapping portion where the first strip portion 331 and the second strip portion 333 bend and bending the first strip portion 331 toward the opposite side are repeated to complete the strip winding portion 340 formed by winding the first strip portion 331 and the second strip portion 333 as shown in FIG. 10. In this way, different structural states can be achieved through the flexible heat dissipation device 300 according to the shape and heat dissipation requirements of the application apparatus.

Still refer to FIG. 10. In this embodiment, the base 310 includes a first body 310A and a second body 310B on opposite sides. In this embodiment, one of the fitting portions 350 is fitted to the first body 310A, and the other of the fitting portions 350 is fitted to the second body 310B. As shown in FIG. 13, to prevent each heat dissipation element 330 from being arranged side by side on a same side and affecting the heat dissipation effect, the heat dissipation elements 330 are staggered in sequence on two sides of the base 310 to maintain a space for the airflow to pass through. In addition, as shown in FIG. 13, the first strip portion 331 further includes a first tail end portion 335, the first tail end portion 335 is connected to an other end of the first strip portion 331 that is relative to the first end portion 332, the second strip portion 333 further includes a second tail end portion 336, and the second tail end portion 336 is connected to an other end of the second strip portion 333 that is relative to the second end portion 334. In addition, the first tail end portion 335 is connected to the second tail end portion 336. As shown in FIG. 13, in this embodiment, the folded edge of the overlapping portion where the first strip portion 331 and the second strip portion 333 bend forms an angle of approximately 45 degrees with the long axis C4 of the second strip portion 333, so that the folded portion 360 is triangular, and the fitting portion 350 is triangular, but the present disclosure is not limited thereto. According to different included angles, the folded portion 360 may also have different shapes.

Figure 15:
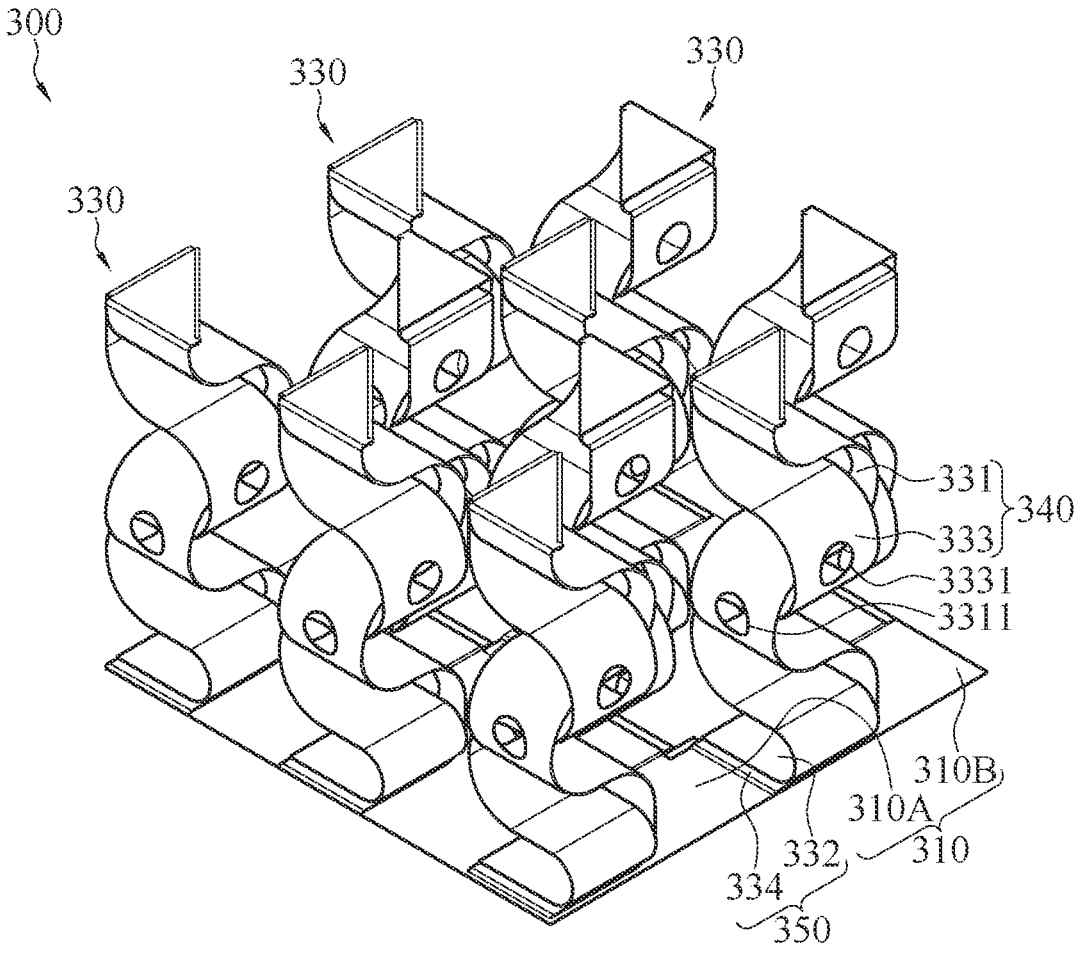
FIG. 15 is a three-dimensional diagram of a flexible heat dissipation device according to some embodiments.

Refer to FIG. 15. FIG. 15 is a three-dimensional diagram of a flexible heat dissipation device according to some embodiments. The first strip portion 331 further comprising a plurality of first openings 3311 arranged equidistantly, the second strip portion 333 further comprising a plurality of second openings 3331 arranged equidistantly, and the plurality of first openings 3311 and the plurality of second openings 3331 are alternately arranged in the strip winding portion 340. As shown in FIG. 15, the plurality of first openings 3311 in the strip winding portion 340 are respectively located at peaks of bends of the first strip portion 331, and the plurality of second openings 3331 are respectively located at peaks of bends of the second strip portion 333. The staggered first openings 3311 and the second openings 3331 are formed in this way, to improve the heat dissipation effect of the heat dissipation element 330 through the plurality of openings.

Still refer to FIG. 10. In this embodiment, the heat dissipation element 330 connected to a left side of the first body 310A and a right side of the second body 310B in FIG. 10 may be, for example, the flexible heat dissipation device 100 in the foregoing embodiment. For example, one of the first end portion 112 and the second end portion 122 of the flexible heat dissipation device 100 is connected to the base 310, and the foregoing winding process is performed. Further, the fitting portion 140 of the flexible heat dissipation device 100 which completes winding is fitted on the base 310. In this embodiment, the flexible heat dissipation device 100 and the flexible heat dissipation device 300 may be integrally formed.

In conclusion, a flexible heat dissipation device is provided in an embodiment. The first flexible heat dissipation strip and the second flexible heat dissipation strip form a staggered first openings portion, and may be fitted on an apparatus through the fitting portion. Based on the flexibility of the flexible heat dissipation device, the flexible heat dissipation device can be applied to various apparatuses. According to a shape, a structure, and the like of an internal space of the apparatus, the heat dissipation device can also be bent into a shape suitable for arrangement.

What is claimed is:

1. A flexible heat dissipation device, comprising:

a first flexible heat dissipation strip, comprising a first body portion and a first end portion, the first end portion being connected to the first body portion; and a second flexible heat dissipation strip, comprising a second body portion and a second end portion, the second end portion being connected to the second body portion, wherein;

the first body portion and the second body portion form a strip winding portion, the first end portion and the second end portion are planes, and the first end portion overlaps and is connected to the second end portion to form a planar fitting portion.

2. The flexible heat dissipation device according to claim 1, wherein the first end portion overlaps the second end portion.

3. The flexible heat dissipation device according to claim 1, wherein the first flexible heat dissipation strip further comprises a first tail end portion, the first tail end portion is connected to an other end of the first body portion, the second flexible heat dissipation strip further comprises a second tail end portion, and the second tail end portion is connected to an other end of the second body portion.

4. The flexible heat dissipation device according to claim 3, wherein the first tail end portion is connected to the second tail end portion.

5. The flexible heat dissipation device according to claim 4, wherein the first flexible heat dissipation strip and the second flexible heat dissipation strip are integrally formed.

6. The flexible heat dissipation device according to claim 4, wherein the first tail end portion and the second tail end portion form a folded portion, the folded portion is triangular.

7. The flexible heat dissipation device according to claim 1, wherein the first body portion further comprising a plurality of first opening portions, each of the plurality of first opening portions is equidistantly arranged, the second body portion further comprising a plurality of second opening portions, and each of the plurality of second opening portions is equidistantly arranged.

8. The flexible heat dissipation device according to claim 1, further comprising:

a third flexible heat dissipation strip, comprising a third body portion and a third end portion, the third end portion being connected to the third body portion; and a fourth flexible heat dissipation strip, comprising a fourth body portion and a fourth end portion, the fourth end portion being connected to the fourth body portion;

wherein the third body portion and the fourth body portion form an other strip winding portion, and the third end portion is connected to the fourth end portion to form an other fitting portion;

wherein a first extending portion extends from one of the first end portion or the second end portion, a second extending portion extends from the third end portion or the fourth end portion, and the first extending portion is connected to the second extending portion.

9. The flexible heat dissipation device according to claim 8, wherein the first flexible heat dissipation strip, the second flexible heat dissipation strip, the third flexible heat dissipation strip, and the fourth flexible heat dissipation strip are integrally formed.

10. The flexible heat dissipation device according to claim 8, wherein the fitting portion and the other fitting portion are located on a same plane.

11. The flexible heat dissipation device according to claim 8, further comprising a bending portion, wherein the bending portion is connected between one of the first flexible heat dissipation strip and the second flexible heat dissipation strip and one of the third flexible heat dissipation strip and the fourth flexible heat dissipation strip.

12. The flexible heat dissipation device according to claim 1, wherein at least part of the first flexible heat dissipation strip and the second flexible heat dissipation strip overlap each other.

* * * * *